US009482496B1

(12) United States Patent
Rocchi et al.

(10) Patent No.: US 9,482,496 B1
(45) Date of Patent: Nov. 1, 2016

(54) WALL-MOUNTED NONLETHAL DEVICE FOR DEFENDING AGAINST INTRUDERS

(71) Applicant: Fighting Chance Systems, Inc., Cadiz, OH (US)

(72) Inventors: James Anthony Rocchi, Cadiz, OH (US); Thomas John Stewart, St. Clairsville, OH (US)

(73) Assignee: Fighting Chance Systems, Inc., Cadiz, OH (US)

( * ) Notice: Subject to any disclaimer, the term of this patent is extended or adjusted under 35 U.S.C. 154(b) by 0 days.

(21) Appl. No.: 14/727,423

(22) Filed: Jun. 1, 2015

(51) Int. Cl.
*F41H 9/04* (2006.01)

(52) U.S. Cl.
CPC ..... *F41H 9/04* (2013.01)

(58) Field of Classification Search
CPC ..... F41H 9/04; F41H 9/00; F41H 9/06; F41H 9/10; G08B 15/00; G08B 15/004; G08B 15/02; G08B 15/001
See application file for complete search history.

(56) References Cited

U.S. PATENT DOCUMENTS 1,995,962 A * 3/1935 Clark ..... F41H 9/04 239/203
2,072,941 A * 3/1937 Burch, Jr. ..... F41H 9/04 102/367
2,989,214 A * 6/1961 Manheimer ..... B65D 83/267 222/180
3,230,912 A * 1/1966 Hohmann ..... E05G 5/00 109/20
3,899,105 A * 8/1975 Fegley ..... B65D 83/267 116/100
4,024,830 A * 5/1977 Fegley ..... G08B 13/08 116/142 FP
4,024,986 A * 5/1977 Fegley ..... G08B 15/02 109/31
4,055,277 A * 10/1977 Fegley ..... G08B 15/02 116/75

(Continued)

*Primary Examiner* — Bret Hayes
*Assistant Examiner* — Derrick Morgan
(74) *Attorney, Agent, or Firm* — Porter, Wright, Morris & Arthur, LLP

(57) ABSTRACT

A system for defending against an intruder includes a building having a wall dividing first and second spaces and a nonlethal device selectively operable through the wall. The nonlethal device includes an enclosure mounted to the wall and having an access door for selectively accessing an interior compartment of the enclosure from the first space, a container of a nonlethal chemical weapon, such as a lachrymatory agent, having an outlet and located within the enclosure, a conduit extending from the container to the second space through the wall and having an inlet in fluid flow communication with the outlet of the container of nonlethal chemical weapon, and a valve operable to selectively release the nonlethal chemical weapon from the container and through the conduit to the second space to form a cloud of the nonlethal chemical weapon within the second space.

20 Claims, 12 Drawing Sheets

(56) References Cited

U.S. PATENT DOCUMENTS 4,062,303 A * 12/1977 Fegley ..... G08B 15/02 109/29
4,063,664 A * 12/1977 Meetze, Jr. ..... B65D 83/262 222/648
4,090,644 A * 5/1978 Fegley ..... B65D 83/267 222/180
4,202,471 A * 5/1980 Fegley ..... G08B 15/02 222/153.11
4,454,963 A * 6/1984 Fegley ..... B65D 83/267 222/160
4,454,966 A * 6/1984 Hicks ..... A45D 34/02 222/153.11
4,841,752 A * 6/1989 Fletcher ..... G08B 15/02 109/20
4,867,076 A * 9/1989 Marcone ..... G08B 15/02 109/20
4,903,863 A * 2/1990 Fink ..... B65D 83/267 116/75
5,311,166 A * 5/1994 Frye ..... G08B 15/00 109/20
5,394,139 A * 2/1995 Dards ..... G08B 15/02 102/334
5,531,344 A * 7/1996 Winner ..... B65D 83/262 222/1
5,655,461 A * 8/1997 Gilbert ..... G08B 15/02 109/20
5,703,563 A * 12/1997 Abe, Jr. ..... B60R 25/00 180/287
5,734,325 A * 3/1998 Johnson ..... G08B 15/02 340/545.6
5,770,283 A * 6/1998 Gosselin ..... G09F 3/0292 206/807
5,819,124 A * 10/1998 Somner ..... G08B 13/19632 396/263
5,881,915 A * 3/1999 Smrz ..... G08B 15/02 109/20
6,039,212 A * 3/2000 Singh ..... B65D 83/262 222/30
6,087,935 A * 7/2000 Berner ..... E05G 1/12 102/334
6,696,928 B1 * 2/2004 Boveja ..... B60R 25/00 244/1 R
6,722,529 B2 * 4/2004 Ceppaluni ..... A61L 9/14 222/63
7,270,802 B2 * 9/2007 Loghman-Adham .. G08B 15/02 424/43
9,089,622 B2 * 7/2015 Helf ..... A61L 9/14
9,262,902 B2 * 2/2016 Costa ..... G08B 15/02
2002/0008620 A1 * 1/2002 Whalen ..... G08B 15/004 340/540
2003/0075644 A1 * 4/2003 Temple ..... B64C 1/1469 244/118.5
2003/0145851 A1 * 8/2003 Johnson ..... B64D 13/00 128/203.12
2004/0046669 A1 * 3/2004 Chiapperini ..... F41H 9/10 340/574
2006/0049931 A1 * 3/2006 Sugimura ..... G08B 15/02 340/500
2006/0086348 A1 * 4/2006 Song ..... G08B 15/007 124/56
2006/0210421 A1 * 9/2006 Hammond ..... A61L 9/03 422/3
2008/0111687 A1 * 5/2008 Husmann ..... G08B 15/02 340/552
2009/0315703 A1 * 12/2009 Ross, Jr. ..... G08B 15/02 340/539.11
2010/0265066 A1 * 10/2010 Edelman ..... A01M 29/00 340/541
2011/0050418 A1 * 3/2011 Hart ..... G08B 15/02 340/541
2012/0325127 A1 * 12/2012 Adrain ..... G08B 15/02 109/31
2013/0020409 A1 * 1/2013 Bartlett ..... B05B 15/001 239/288
2014/0158027 A1 * 6/2014 Bolden ..... G08B 15/02 109/29
2014/0306818 A1 * 10/2014 Batchelder ..... G08B 15/02 340/501
2015/0061869 A1 * 3/2015 Crowe ..... G08B 15/02 340/541
2015/0124087 A1 * 5/2015 Jones, Jr. ..... G08B 25/14 348/143
2016/0000275 A1 * 1/2016 Sellars ..... A47K 10/38 242/595
2016/0018194 A1 * 1/2016 Childs ..... F41H 9/10 222/173
2016/0060009 A1 * 3/2016 Verhoeven ..... G06K 19/07762 235/492

* cited by examiner

WALL-MOUNTED NONLETHAL DEVICE FOR DEFENDING AGAINST INTRUDERS

CROSS-REFERENCE TO RELATED APPLICATIONS

Not Applicable

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to means for defending against intruders and, more particularly, to nonlethal means for defending against a person entering a building, such as a school and the like, with criminal intent.

BACKGROUND OF THE INVENTION

It has become too common that an individual enters a school or other building and threatens and/or causes physical injury to one or more occupants of the building. As a result, many buildings now have security guards and/or metal detectors posted at entrances. While these security methods have been somewhat effective, sufficiently motivated and/or deranged individuals can find ways to circumvent these "gatekeeping" types of protections. This has prompted many policymakers and education leaders to wrestle with the question of equipping school security and/or teachers with nonlethal and/or lethal weapons. Implementation of even nonlethal weapons has been limited due to concerns that such weapons could be turned against students.

Accordingly, there is a need for improved nonlethal methods and devices for defending against intruders of buildings such as schools and the like.

SUMMARY OF THE INVENTION

Disclosed are nonlethal methods and devices for defending against intruders of buildings which address one or more issues of the related art. Disclosed is a nonlethal device for defending against an intruder to a building operable through a wall dividing first and second spaces. The nonlethal device comprises, in combination, an enclosure configured to be mounted to the wall and including an access door for selectively accessing an interior compartment of the enclosure from the first space, a container of a nonlethal chemical weapon having an outlet and located within the enclosure, a conduit configured to extend from the container to the second space through the wall and having an inlet in fluid flow communication with the outlet of the container of the nonlethal chemical weapon, and a valve operable to selectively release the nonlethal chemical weapon from the container and through the conduit.

Also disclosed is a system for defending against an intruder comprising, in combination, a building having a wall dividing first and second spaces and a nonlethal device operable through the wall. The nonlethal device includes an enclosure mounted to the wall and having an access door for selectively accessing an interior compartment of the enclosure from the first space, a container of a nonlethal chemical weapon having an outlet and located within the enclosure, a conduit extending from the container to the second space through the wall and having an inlet in fluid flow communication with the outlet of the container of the nonlethal chemical weapon, and a valve operable to selectively release the nonlethal chemical weapon from the container and through the conduit to the second space to form a cloud of the nonlethal chemical weapon within the second space.

Also disclosed is a nonlethal device for defending against an intruder to a building operable through a wall dividing first and second spaces. The nonlethal device comprises, in combination, an enclosure configured to be mounted to the wall and including an access door for selectively accessing an interior compartment of the enclosure from the first space, a canister of a nonlethal lachrymator located within the enclosure and having an outlet and a manually-operated valve for selectively opening the valve, and a flexible plastic tube extending from the canister and out of the enclosure and configured to pass through the wall. The flexible plastic tube has an inlet in fluid flow communication with the outlet of the canister within the enclosure and an outlet configured to be positioned at the second space. The manually-operated valve is configured to be selectively actuated through the access door by an operator located within the first space to release the nonlethal lachrymator from the canister within the enclosure to the second space through the flexible plastic tube to form a cloud of the nonlethal lachrymator within the second space.

From the foregoing disclosure and the following more detailed description of various preferred embodiments it will be apparent to those skilled in the art that the present invention provides a significant advance in the technology and art of nonlethal methods and devices for defending against intruders of buildings. Particularly significant in this regard is the potential the invention affords for providing a versatile and easy to use wall-mounted device that has limited access but is available when an intruder is present without exposing the operator to the intruder. Additional features and advantages of various preferred embodiments will be better understood in view of the detailed description provided below.

BRIEF DESCRIPTION OF THE DRAWINGS

These and further features of the present invention will be apparent with reference to the following description and drawings.

Figure 1:
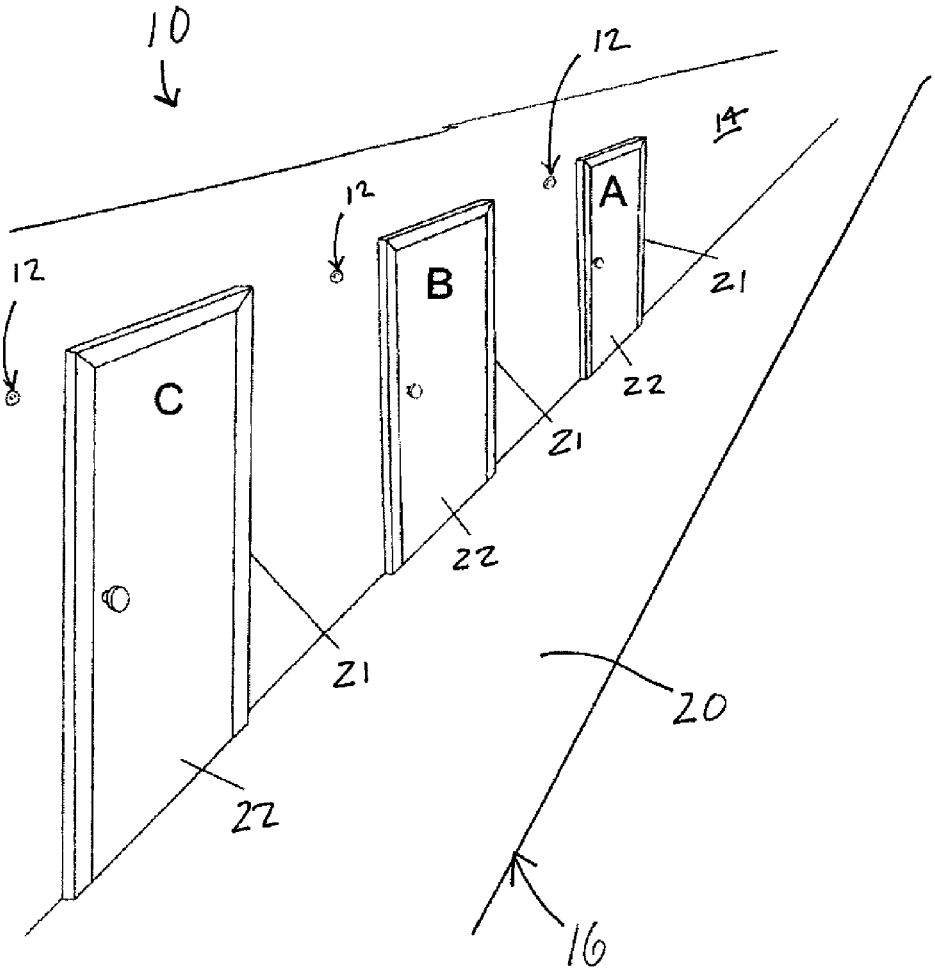
FIG. 1 is a perspective view of an interior hallway of a building having a system for defending against intruders according to the present invention that includes a plurality of wall-mounted nonlethal devices located in close proximity to interior doors in the hallway.

It should be understood that the appended drawings are not necessarily to scale, presenting a somewhat simplified representation of various preferred features illustrative of the basic principles of the invention. The specific design features of the nonlethal devices as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the nonlethal devices illustrated in the drawings. In general, up or upward generally refers to an upward direction within the plane of the paper in FIG. 2 and down or downward generally refers to a downward direction within the plane of the paper in FIG. 2. In general, front or forward generally refers to a leftward direction within the plane of the paper in FIG. 2 and rear or rearward generally refers to a rightward direction within the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the nonlethal devices and methods disclosed herein. The following detailed discussion of various alternative and preferred embodiments will illustrate the general principles of the invention. Other embodiments suitable for other applications will be apparent to those skilled in the art given the benefit of this disclosure.

Figure 2:
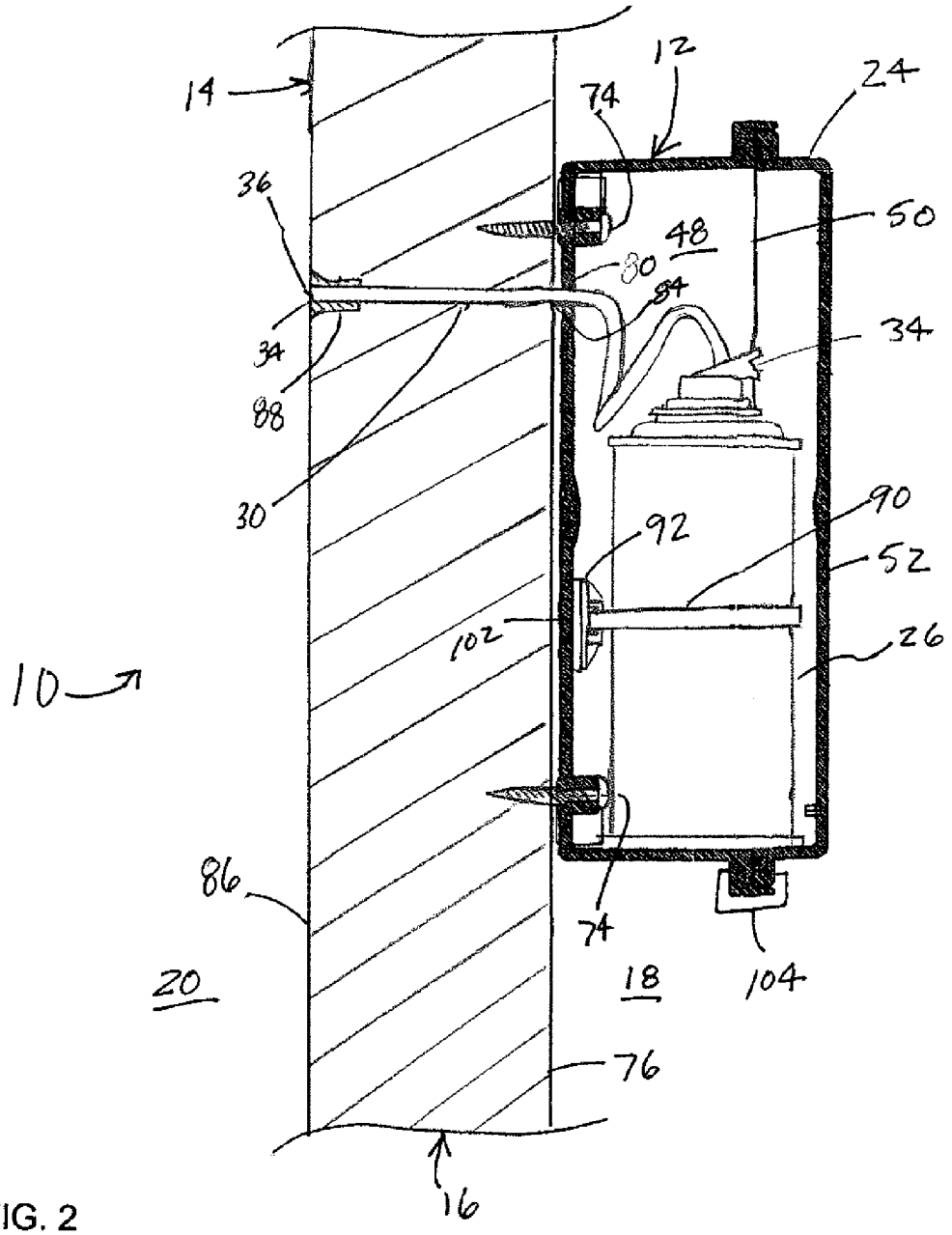
FIG. 2 is an enlarged cross-sectional view of the wall-mounted nonlethal devices of FIG. 1.
Figure 3:
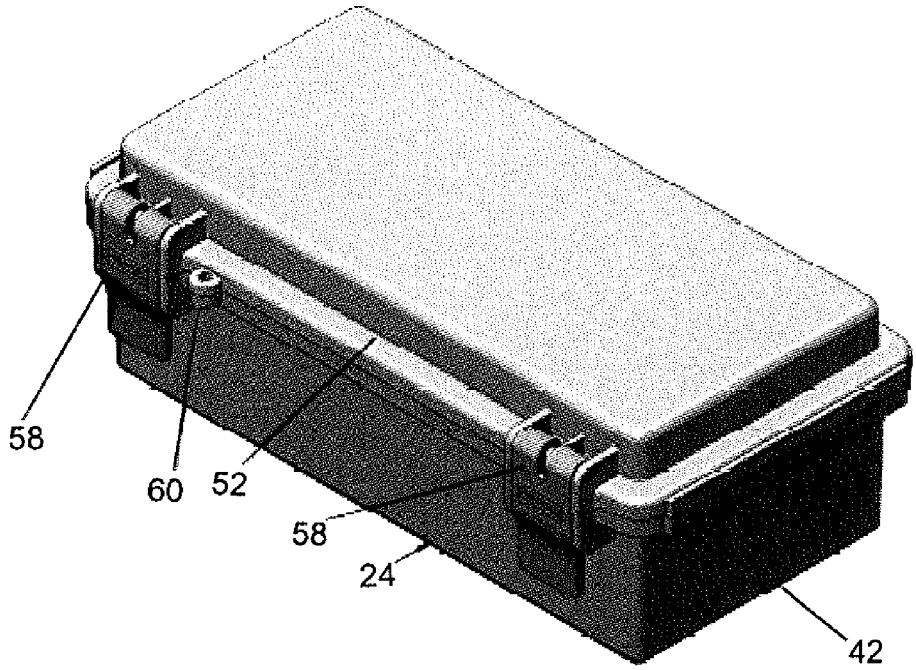
FIG. 3 is perspective view of a sealed enclosure of the wall-mounted nonlethal devices of FIGS. 1 and 2, wherein a rear door is in a closed and latched position.
Figure 4:
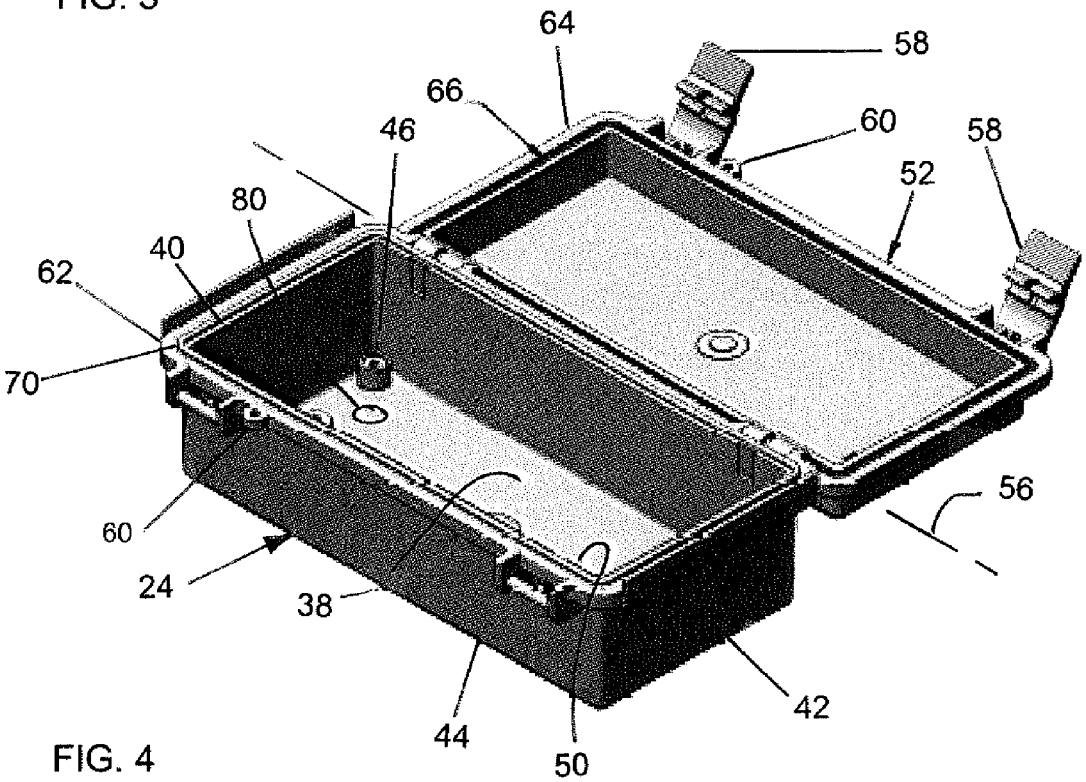
FIG. 4 is perspective view of the sealed enclosure of FIG. 4, wherein the rear door is in an open position.
Figure 5:
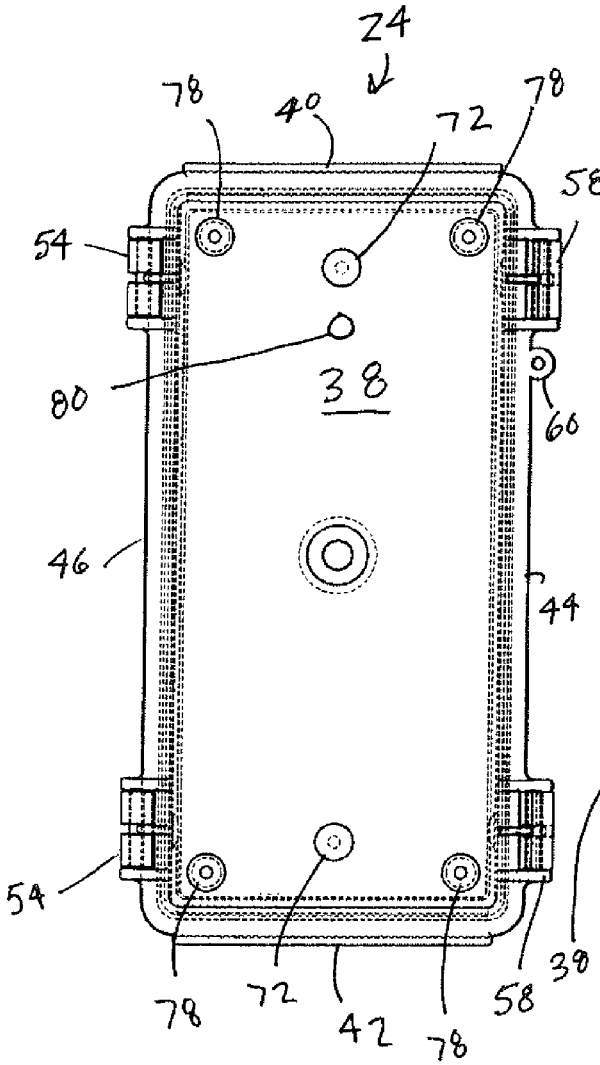
FIG. 5 a front elevational view of the sealed enclosure of FIGS. 3 and 4.
Figure 6:
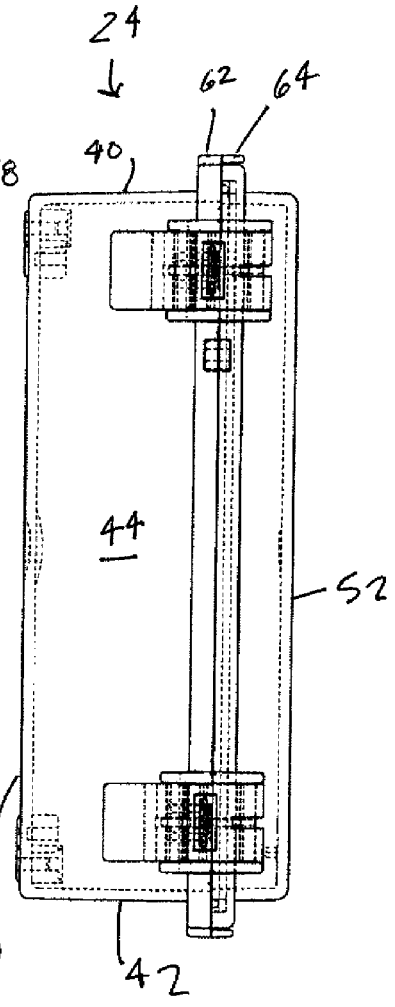
FIG. 6 is a left-side elevational view of the sealed enclosure of FIGS. 3 to 5.
Figure 8:
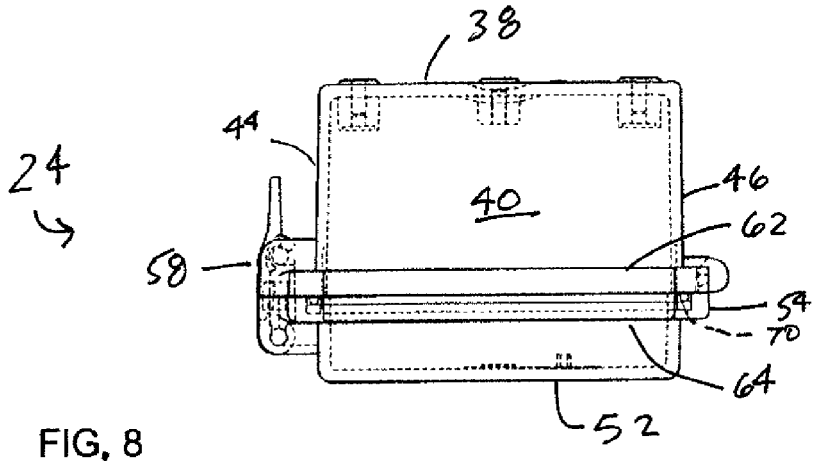
FIG. 8 is a top plan view of the sealed enclosure of FIGS. 3 to 7.
Figure 7:
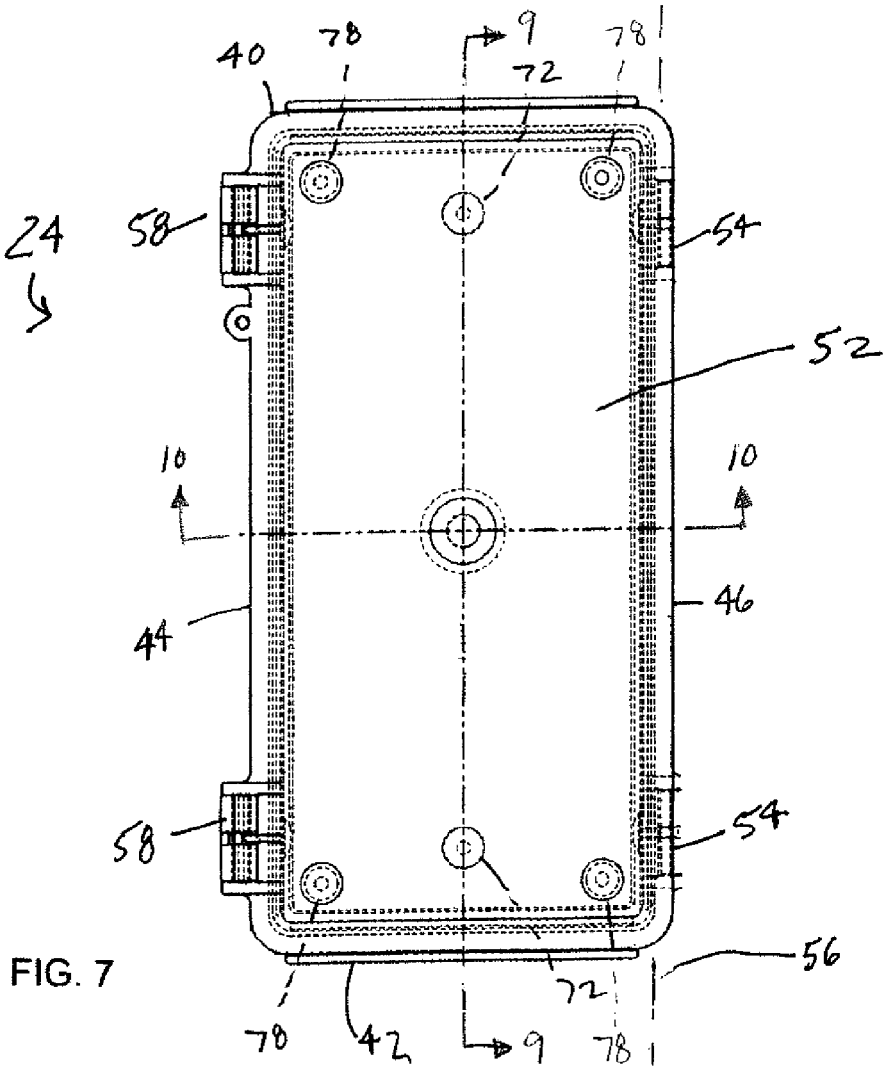
FIG. 7 is a rear elevational view of the sealed enclosure of FIGS. 3 to 6.
Figure 10:
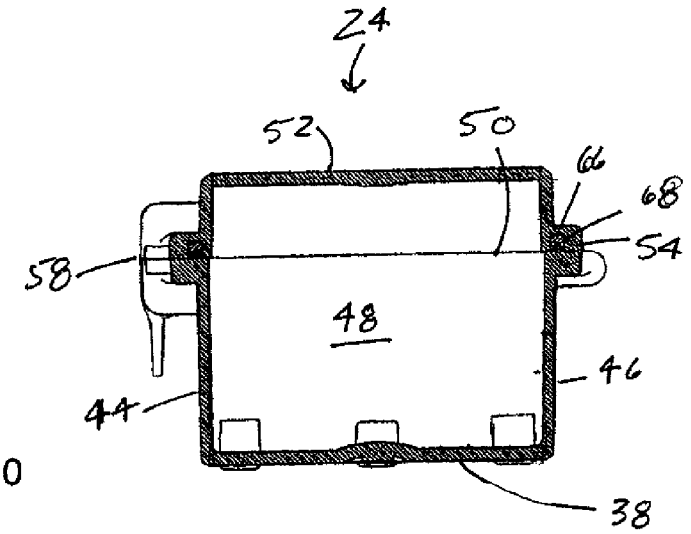
FIG. 10 is a cross-sectional view of the sealed enclosure taken along line 10-10 of FIG. 7.
Figure 9:
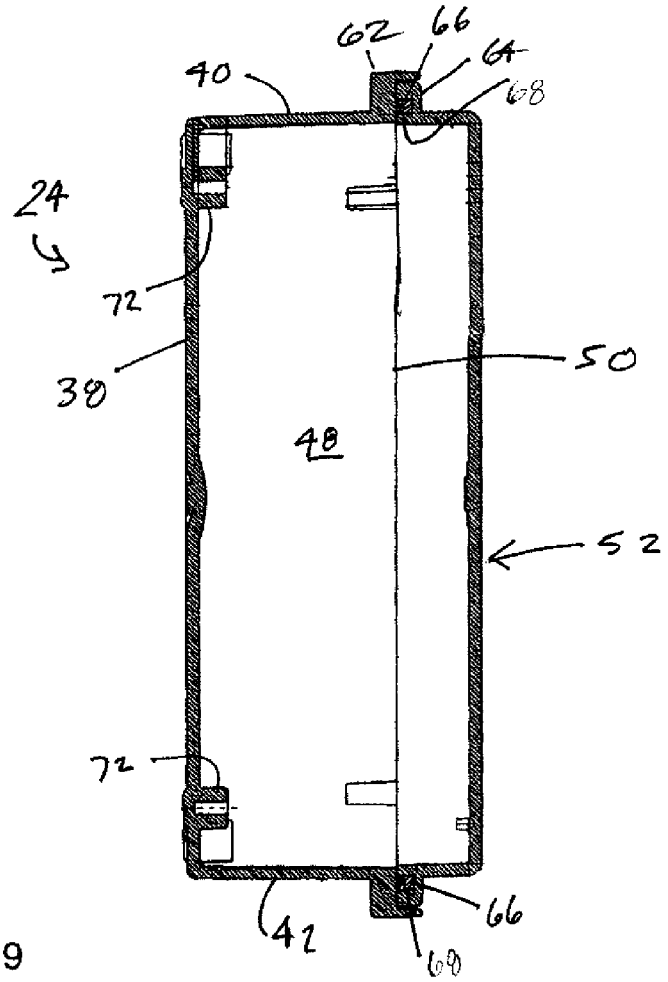
FIG. 9 is a cross-sectional view of the sealed enclosure taken along line 9-9 of FIG. 7.

Referring now to the drawings, FIGS. 1 and 2 show a system 10 for defending against building intruders according to the present invention that includes a plurality of wall-mounted nonlethal devices 12. The illustrated wall-mounted nonlethal devices 12 are mounted to an interior wall 14 of a structure or building 16 such as, for example, a school building and the like. The illustrated interior wall 14 divides first or room space 18 and a second or hallway space 20 and each of the illustrated wall-mounted nonlethal devices 12 operate between one of the first or room spaces 18 and the second or hallway space 20. It is noted that any other suitable type of wall and/or spaces divided by the wall can alternatively be utilized. The illustrated wall-mounted nonlethal devices 12 are mounted near door frames 21 for interior doors 22 but can alternatively be located at any other suitable location. While the illustrated system 10 includes three of the wall-mounted nonlethal devices 12, the system 10 can alternatively include quantities of one or more of the wall-mounted nonlethal devices 12. For example, when the building 16 is a school building, each classroom would preferably be provided with an associated one of the wall-mounted nonlethal devices 12.

Each of the illustrated wall-mounted nonlethal devices 12 includes a sealed enclosure 24 configured to be mounted to the interior wall 22, a container 26 of a nonlethal chemical weapon, such as a nonlethal lachrymator or lachrymatory agent, having an outlet 28 and located within the sealed enclosure 24, a conduit 30 configured to extend from the container 26 to the second space 20 through the interior wall 14 and having an inlet 32 in fluid flow communication with the outlet 28 of the container 26 of the nonlethal chemical weapon, and a valve 34 operable to selectively release the nonlethal chemical weapon from the container 26 and through the conduit 30 to an outlet 36 of the conduit 30.

As best shown in FIGS. 3 to 10, the illustrated sealed enclosure 24 is generally rectangular-shaped and includes a planer front wall 38, a planar top wall 40 perpendicularly extending in a rearward direction from a top edge of the front wall 38, a planar bottom wall 42 perpendicularly extending in a rearward direction from a bottom edge of the front wall 38 and parallel with the top wall 40, and left and right side walls 44, 46 perpendicularly extending in a rearward direction from left and right side edges of the front wall 38 respectively and connecting the top and bottom walls 40, 42. Configured in this manner the front, top, bottom left side, and right side walls 38, 40, 42, 44, 46 cooperate to form an interior space or compartment 48 accessible through a rearward-facing opening 50. The illustrated sealed enclosure 24 also includes an access door 52 configured for selectively closing the rearward-facing opening 50 so that the interior compartment 48 is a sealed to prevent the escape of any fluid and/or vapor therein when in a closed position and for selectively accessing the interior compartment 48 of the sealed enclosure 24 through the rearward-facing opening 50 when the in a closed position. The illustrated access door 52 is provided with a pair of spaced-apart hinges 54 located between the right side wall 46 and the access door 52 so that the access door 52 can pivot about a pivot axis 56 formed by the hinges 54 between its closed position (wherein the access door 52 closes the rearward-facing opening 50) and its open position (wherein the access door 52 is away from the rearward-facing opening 50 so that the interior compartment 48 can be accessed through the rearward-facing opening 50). The illustrated access door 52 is also provided with a pair of spaced-apart latches 58 located between the left side wall 44 and the access door 52 so that the access door 52 can be selectively held in its closed position when the latches 58 are locked and can selectively be moved out of its closed position when the latches 58 are unlocked. It is noted that the hinges 54 and the latches 58 can be of any suitable type and/or the access door 52 can alternatively be removably secured in any other suitable manner. The illustrated sealed enclosure 24 also includes cooperating padlock tabs 60 that can be used with a lock such as a key padlock, combination padlock, and the like to deter tampering. It is noted that any other suitable kind of lock can alternatively be utilized such as, for example, an internal bolt-style lock and the like. It is also noted that the padlock tabs 60 can be used with a security seal as described in more detail hereinbelow.

The illustrated sealed enclosure 24 is also provided with a rearward-facing rim or flange 62 encircling the rearward-facing opening 50 and configured to cooperate with a forward facing rim or flange 64 encircling the access door 52 that engages the rearward facing rim 62 when the access door 52 is in the closed position to seal the interior compartment 48. The illustrated rim 64 of the access door 52 is provided with a flexible O-ring-type seal or gasket 66 in a seal or gasket groove 68 that encircles the rearward-facing opening 50 to seal the opening 50 when the seal 66 engages the opposed rim 62. The illustrated opposed rim 62 is provided with a rearward-extending protrusion 70 sized and shaped to ensure engagement with the flexible seal 66 when the access door 52 is in the closed position. The illustrated flexible seal 66 is a foam gasket but any other suitable type of seal can be alternatively utilized. It is noted that the rearward-facing opening 50 can alternatively be sealed in any other suitable manner.

The front wall 38 of the illustrated sealed enclosure 24 is provided with a pair of vertically spaced-apart outwardly-directed closed bosses 72 configured to cooperate with self-threading or thread-cutting fasteners 74 to secure the sealed container 24 to the inner surface 76 of the interior wall 14 (best shown in FIG. 2). As the fasteners 74 are threaded outwardly through the closed bosses 72, they cut/thread through the closed bosses 72 in a manner which maintains the interior compartment 48 as a sealed space when the access door 52 is in its closed position. If the closed bosses 72 are not utilized, they remain closed which maintains the interior compartment 52 as a sealed space. The front wall 38 of the illustrated sealed enclosure 24 is also provided with four inwardly directed closed bosses 78 configured to cooperate with self-threading fasteners to secure mounting brackets to the exterior of the sealed container 24 which are in turn secured to the inner surface 76 of the interior wall 14. This provides an alternate means for mounting the sealed enclosure 24 to the interior wall 14. It is noted that the sealed enclosure 24 can alternatively be mounted to the interior wall 14 in any other suitable manner.

The illustrated sealed enclosure 24 comprises a plastic material but the sealed enclosure 14 can alternatively comprise any other suitable material. A suitable sealed enclosure 24 is believed to be a WH Series Hinged Waterproof NEMA Electrical Enclosure available form Polycase of Avon, Ohio, that has been suitably modified.

Figure 11:
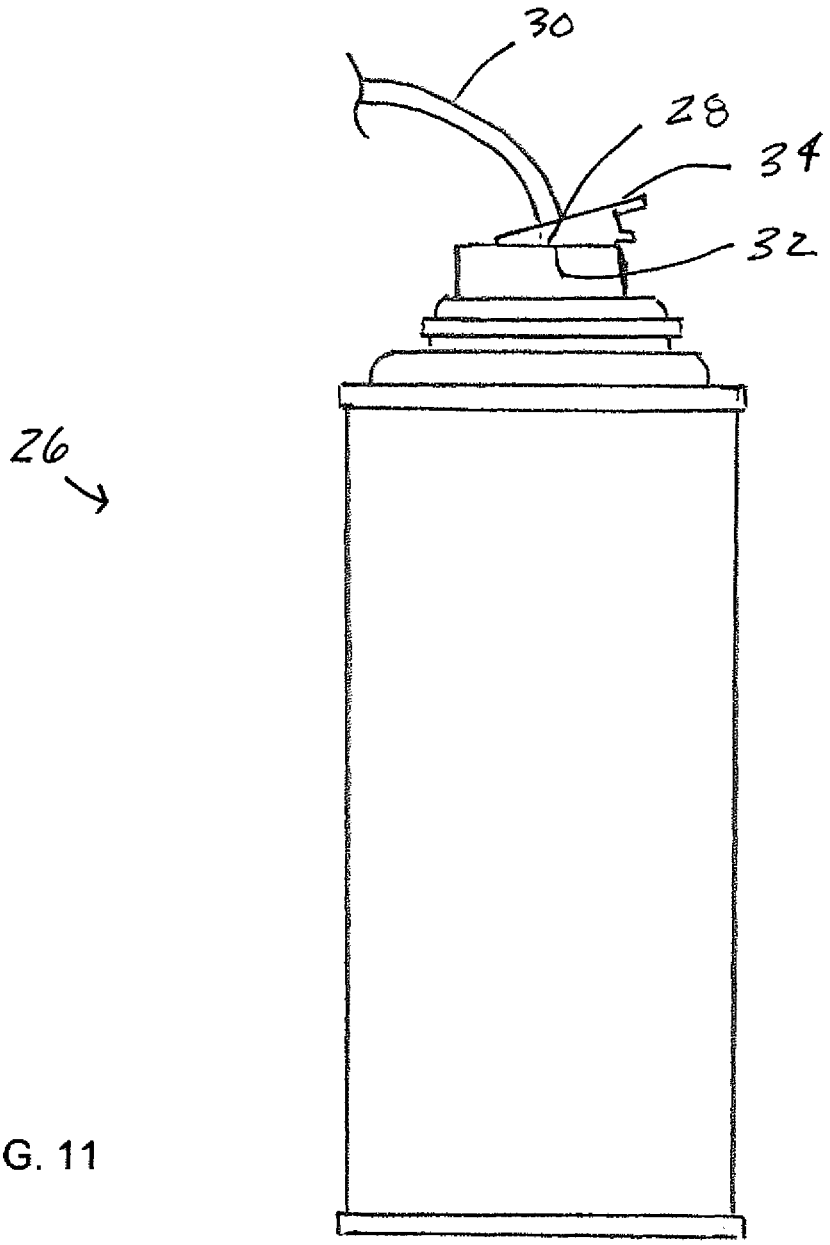
FIG. 11 is an enlarged left side elevational view of a container of a nonlethal chemical weapon of the wall-mounted nonlethal devices of FIGS. 1 and 2.

As best shown in FIG. 11, the illustrated container 26 of nonlethal chemical weapon is an aerosol canister having a sealed interior space containing the nonlethal chemical weapon in a pressurized manner. The illustrated container 26 is generally cylindrical-shaped and has the outlet 28 located at its top that is controlled by the manually-actuated valve 34 also located at the top. The illustrated container 26 is a tinplated steel can but any other suitable materials can alternatively be utilized. When the manually-actuated valve 34 is depressed in a downward direction toward the top of the container 26, the pressurized nonlethal chemical weapon is released through the outlet 28 to form a vapor cloud. The illustrated valve includes a lock so that when it is fully depressed it locks in its fully actuated position and the complete contents of the container are released even if the user is no longer depressing the valve. A suitable container 26 of nonlethal chemical weapon is believed to be Clear Out which is available from Aerko International of Oakland Park, Fla. It is noted that any other suitable type of container and/or valve can alternatively be utilized.

The illustrated conduit 30 is a flexible plastic tube such as, for example, surgical tubing but it is noted that any other suitable type of conduit an alternatively be utilized. The illustrated conduit 30 extends from the outlet 28 of the container 26 of nonlethal chemical weapon to an opening 80 in the forward wall 38 of the sealed enclosure 24, through the opening 80, through an opening 82 at the inner surface 76 of the interior wall 14, and through the interior wall 14 to an opening 84 at the outer surface 86 of the interior wall 14. The conduit 30 and the sealed enclosure opening 80 are sized and shaped so that the conduit 30 seals the sealed enclosure opening 80 as the conduit 30 extends there through but it is noted that any other suitable means to seal the opening 80 can alternatively be utilized. The illustrated outer end or outlet 36 of the conduit 30 located at the outer surface 86 of the interior wall 14 at the second space 20 is provided with a flared tube fitting 88 so that the conduit flush with the outer surface 86 of the interior wall 14. The fitting 88 is preferably secured to the interior wall with adhesive to maintain the outlet 36 of the conduit 30 flush with the outer surface 86 of the interior wall 14. It is noted that any other suitable fitting and/or other holding means can alternatively be utilized.

The illustrated container 26 of nonlethal chemical weapon is secured to the interior of the sealed enclosure 24 so that it does not substantially move or accidentally fall out of the sealed enclosure 24 when the access door 52 is open, and particularly when the nonlethal device 12 is being used in a stressful and critically-important situation. The illustrated container 26 is secured with a plastic tie strap 90 that encircles the container and passes through a tie strap bracket 92 secured to the forward wall 38 within the interior space 48. It is noted that the container 26 can alternatively be secured to the sealed enclosure 24 with any other suitable type of fastener and/or in any other suitable manner. The plastic tie strap 90 or other fastener and the conduit 30 can each be breakable, such as by having a frangible portion, and/or removable so that the plastic tie strap 90 holds the container 26 in place within the sealed enclosure 24 but permits a user to quickly remove the container 26 from the sealed enclosure 24 for deployment of the nonlethal weapon within the first space 18 (and not through the conduit 30 to the second space 20) in situations such as the intruder entering the first space 18.

Figure 12:
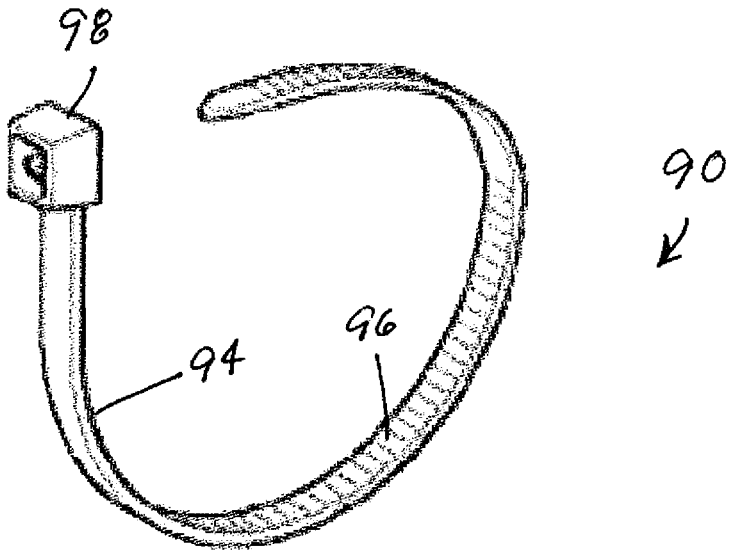
FIG. 12 is an enlarged perspective view of a tie strap of the wall-mounted nonlethal devices of FIGS. 1 and 2.

FIG. 12 illustrates a suitable plastic tie strap 90 that is sometimes referred to as a "cable tie" or "zip tie" or "tie wrap. The illustrated tie strap 90 comprises nylon and has a tape section 94 with teeth 96 that engage a pawl located within a head section 98 located at one end of the tape section 94 to form a ratchet so that as the free end of the tape section 94 is pulled through the head section 98, the tie strap 90 tightens and does not untighten due to the ratchet. To remove the illustrated tie strap 90 it must be cut. Some other versions of the tie strap 90 provide a tab that can be depressed to selectively release the ratchet when it is desired to either adjust the tension or remove the tie strap. It is noted that any other suitable tie strap 90 can alternatively be utilized.

Figure 13:
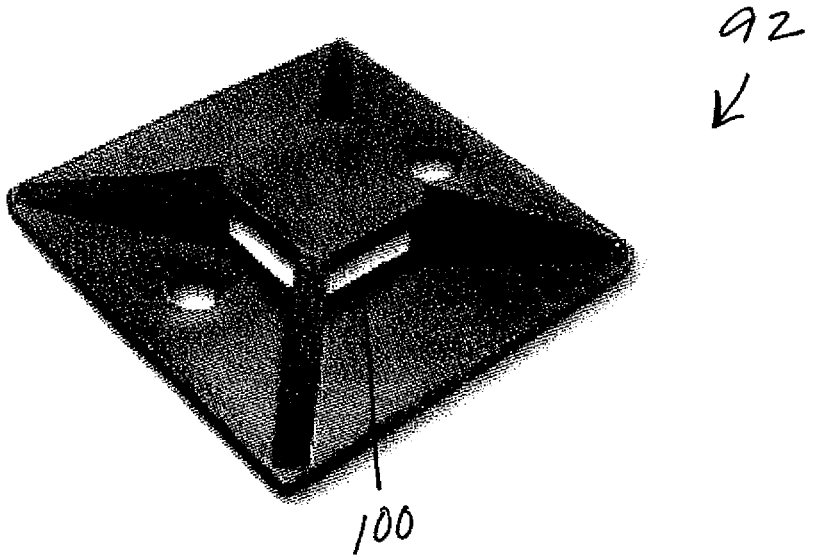
FIG. 13 is an enlarged perspective view of a tie strap bracket of the wall-mounted nonlethal devices of FIGS. 1 and 2.

FIG. 13 illustrates a suitable tie strap bracket 92. The illustrated tie strap bracket 92 comprises a plastic material and has an opening 100 through which the tie strap 90 extends to secure the tie strap 90 to the tie strap bracket 92. The tie strap bracket 92 is in turn secured to the sealed enclosure 24. The illustrated tie strap bracket 92 is secured to the sealed enclosure 24 with double sided tape 102 having a pressure sensitive adhesive but it can alternatively be secured in any other suitable manner. It is noted that any other suitable tie strap bracket 92 can alternatively be utilized.

The illustrated nonlethal chemical weapon is a lachrymator or lachrymator agent configured to form a vapor cloud upon release. Lachrymator or lachrymator agent is a chemical that causes the shedding of tears and/or irritation of the eyes. The nonlethal chemical weapon can comprise at least one of tear gas, capsaicin, pepper spray (OC gas), o-chlorobenzylidene malononitrile, CS gas, dibenzoxazepine (CR gas), phenacyl chloride (CN gas), nonivamide, bromoacetone, xylyl bromide, and syn-propanethial-S-oxide. Clear Out which is available from Aerko International of Oakland Park, Fla. is believed to be a suitable nonlethal chemical weapon that comprises Orthoclorobenzalmolonitrile and Oleo Resin Capsicum dissolved in a blend of highly volatile non-flammable solvents. It is noted that any other suitable nonlethal chemical weapon that forms a vapor cloud when released to irritate the intruder to a degree that they are either incapacitated and/or driven to leave the location can alternatively be utilized.

The illustrated nonlethal device 12 is also provided with a security seal 104 that automatically breaks when the access door 52 is opened to provide tamper evidence, that is, an indication that the interior compartment 48 of the sealed enclosure 24 has been accessed by someone either accidental or deliberate. Preferably, the security seal 104 breaks upon opening the access door 52 without requiring any substantial increase in force to open the access door 52. The illustrated security seal 104 is a tape or label having a high bond strength adhesive in combination with backing that is designed to fracture or delaminate under designated conditions to indicate attempts at opening the enclosure access door 52. It is noted that the security seal 104 can be any other suitable type of security seal such as, for example, a plastic seal or padlock seal used in conjunction with the padlock tabs 60 of the sealed enclosure 24.

In the event of a life-threatening situation, such as an armed intruder located in the second space 20, an adult user within the first space 18 can deploy the nonlethal device 12 through the interior wall 14 to the second space 20. For example, when the building 16 is a school, a teacher within a classroom 18 can deploy the nonlethal device 12 through the interior wall 14 to the hallway 20 where an armed intruder is located. The adult user opens the access door 52 of the sealed enclosure 24 with enough force to break the security seal 104. With the access door 52 pivoted open, the user reaches into the interior space 48 of the enclosure 24 and depresses the manually-actuated valve 34 until it locks into its actuated position and the entire contents of the container 26 are released. With the valve 34 actuated, the pressurized nonlethal chemical weapon flows out of the container 26 and through the conduit 30 to the conduit outlet 36 at the second space 20. The nonlethal chemical weapon dispenses into the second space 20 to form a cloud and thus a barrier between the first and second spaces 18, 20. With the nonlethal device 12 located near the door 22, the cloud of nonlethal chemical weapon forms a barrier at the door 22 between the first and second spaces 18, 20. Once the situation is over, the container 26 of the nonlethal chemical weapon and the security seal 104 can each be replaced so that the nonlethal device 12 is ready to be used in the event of another life threatening situation.

Figure 14:
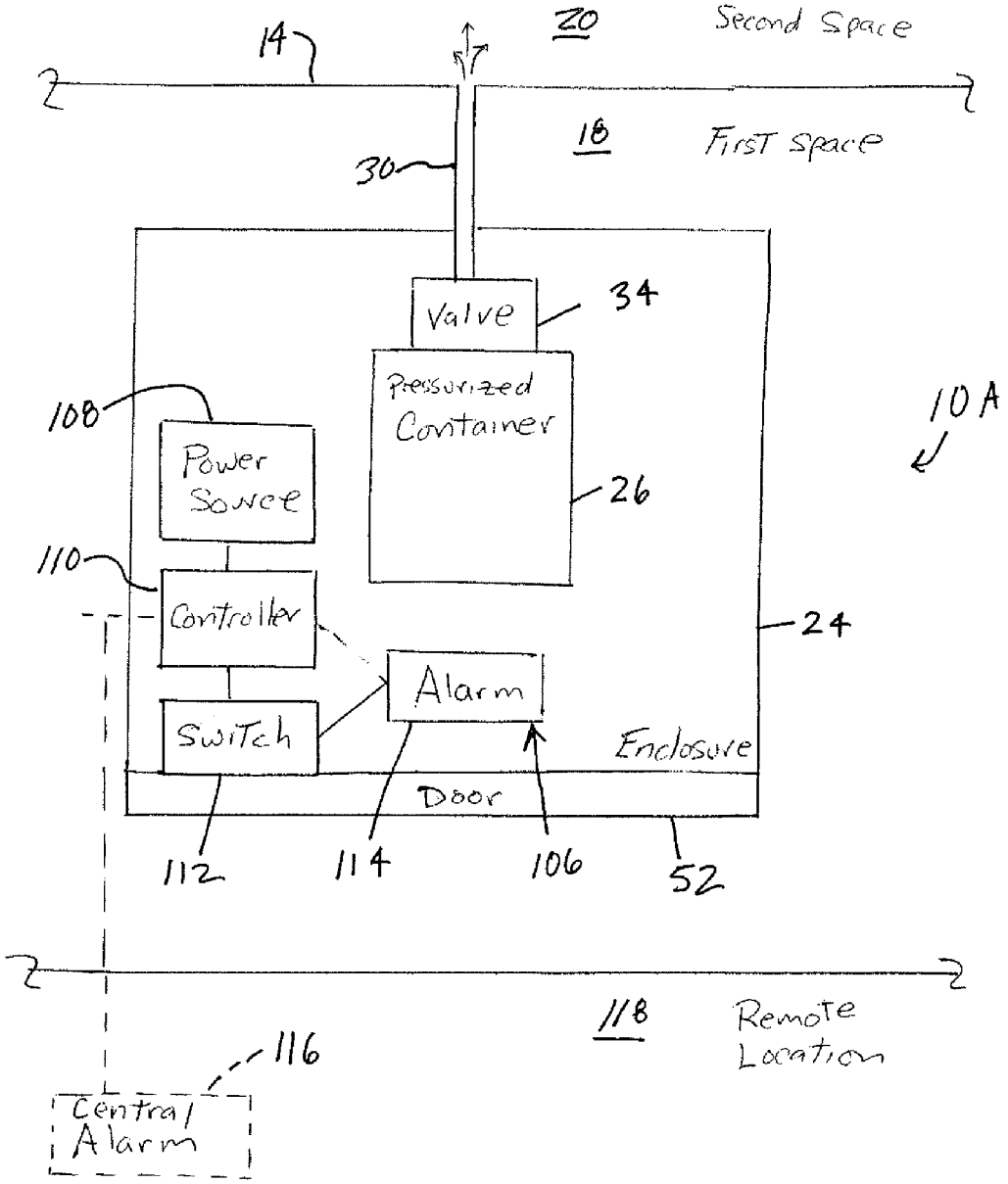
FIG. 14 is a schematic view of a second embodiment of the system for defending against intruders according to the present invention.

FIG. 14 schematically illustrates a system 10A for defending against building intruders according to a second embodiment of the present invention. This second embodiment is substantially the same as the first embodiment described above except that it includes an alarm system 106 that provides an indication that the sealed enclosure 24 is open. The illustrated alarm system 106 includes a power source 108, a controller 110 in communication with the power source 108, a switch 112 in communication with the controller 110, and an alarm 114 in communication with the switch 112 and/or the controller 110. The illustrated power source 108 is located within the sealed enclosure 24 and can be any suitable source of electric power such as, for example, a battery and the like but any other suitable source of electric power can alternatively be utilized such as, for example mains electricity. The illustrated controller 110 is located within the sealed enclosure 24 and includes a processor programmed to perform all necessary functions of the alarm system 106. The illustrated switch 112 is associated with the access door 52 to indicate when the access door 52 is open and/or closed so that the alarm 114 is triggered when the access door 52 is open. The switch 112 can be any suitable type of electric switch. The illustrated alarm 114 is located within the sealed enclosure 24 and is an audible alarm that is activated when the access door 52 is open. It is noted that the alarm 114 can additionally include a visual alarm such as, for example, a strobe light. The alarm 114 can be of any suitable type. A central alarm 116 can additionally or alternatively be in communication with the controller 110, either wired or wireless, and located at a remote location 118 (that is, remote from the first space 18) such as, for example, a security office for the building 16. The central alarm 116 enables a single person to remotely monitor all of the nonlethal devices 12 within the building 16.

Figure 15:
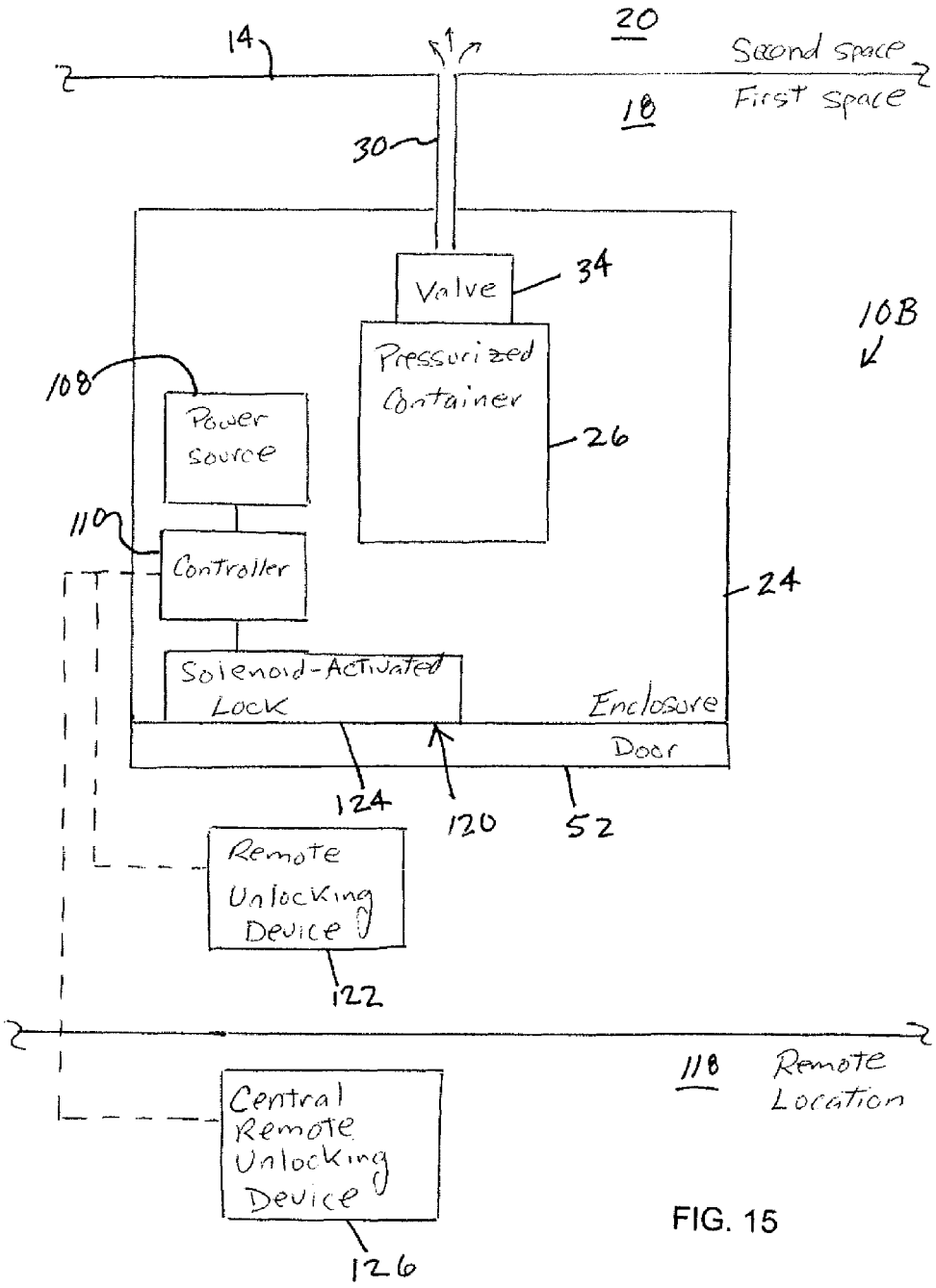
FIG. 15 is a schematic view of a third embodiment of the system for defending against intruders according to the present invention.

FIG. 15 schematically illustrates a system 10B for defending against building intruders according to a third embodiment of the present invention. This third embodiment is substantially the same as the first and second embodiments described above except that it includes a remote unlocking system 120 that can open the sealed enclosure 24 so that only individuals in possession of a remote unlocking device 122 can open the sealed enclosure 24. The illustrated remote unlocking system 120 includes a power source 108, a controller 110 in communication with the power source 108, a solenoid-activated lock 126 in communication with the controller 110, and the remote unlocking device in communication with the controller 110. The illustrated power source 108 is located within the sealed enclosure 24 and can be any suitable source of electric power such as, for example, a battery and the like but any other suitable source of electric power can alternatively be utilized such as, for example mains electricity. The illustrated controller 110 is located within the sealed enclosure 24 and includes a processor programmed to perform all necessary functions of the remote unlocking system 120. The illustrated solenoid-activated lock 124 is associated with the access door 52 to lock and unlock the access door 52 to control access to the internal space 48 of the sealed enclosure 24. The solenoid-activated lock 124 can be any suitable type of remotely controlled lock. The illustrated remote unlocking device 122 is located outside the sealed enclosure 24 and within the first space 18 and has either a wireless or wired connection with the controller 110. The remote unlocking device 122 can be of any suitable type. The remote unlocking device 122 can be carried by a user within the first space 18. For example, when the building 16 is a school and the connection is wireless, a classroom teacher can carry the remote unlocking device 122 within the classroom 18 with a lanyard or the like so that the remote unlocking device 122 is with them at all time while in the classroom 18. Thus, the sealed enclosure 24 can be locked at all times to prevent tampering while the teacher has near immediate access via the remote unlocking device 122. A central remote unlocking device 126 can additionally or alternatively be in communication with the controller 110, either wired or wireless, and located at a remote location 118 (that is, remote from the first space 18) such as, for example, a security office for the building 16. The central remote unlocking device 126 enables a single person to remotely lock and unlock any one, all, or a select number of the nonlethal devices 12 within the building 16.

Figure 16:
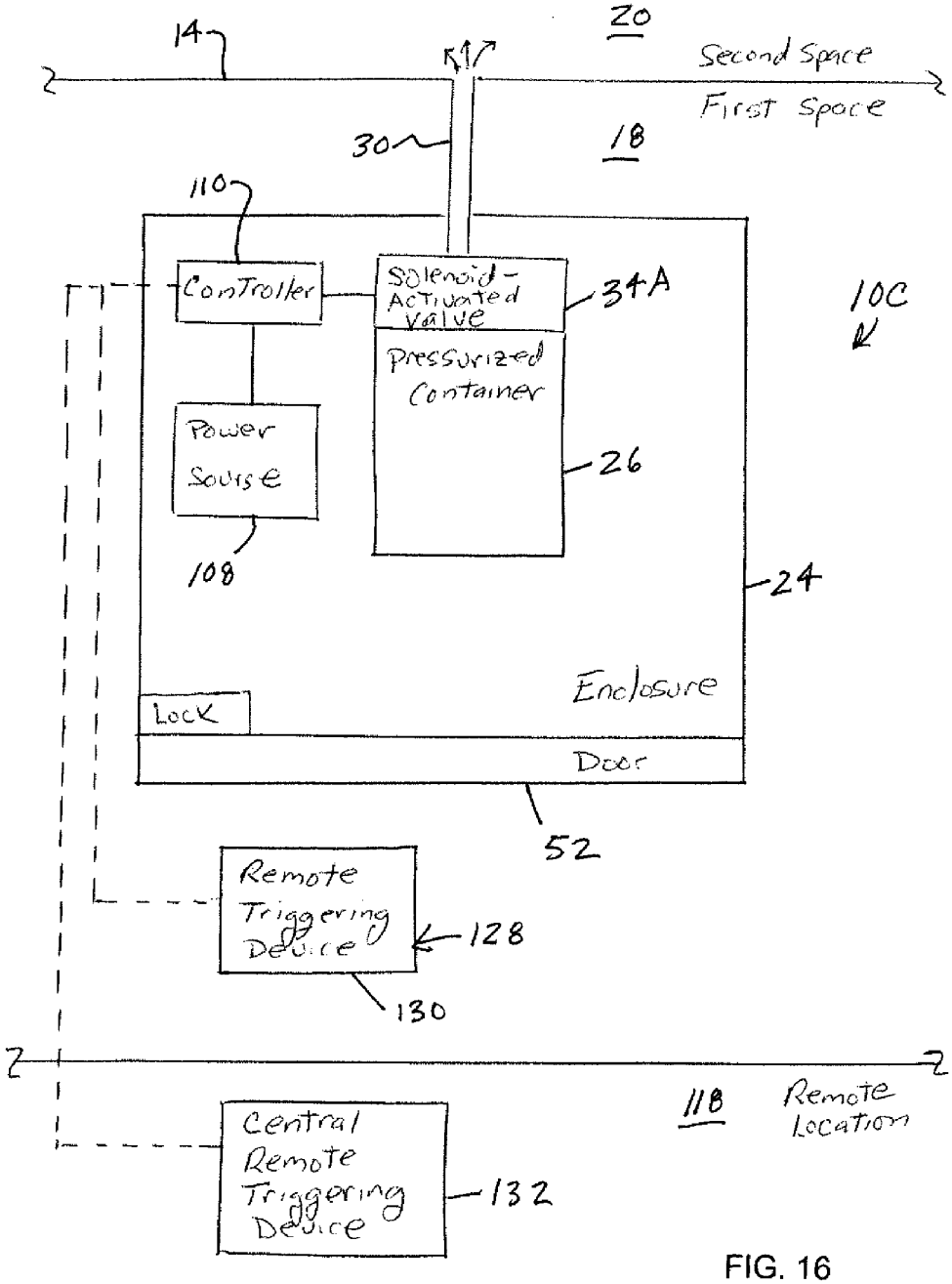
FIG. 16 is a schematic view of a fourth embodiment of the system for defending against intruders according to the present invention.

FIG. 16 schematically illustrates a system 10C for defending against building intruders according to a fourth embodiment of the present invention. This fourth embodiment is substantially the same as the first, second, and third embodiments described above except that it includes a remote triggering system 128 that quickly activates the valve 34 to release the nonlethal chemical weapon without opening the sealed enclosure 24 so that the valve 34A can be quickly activated while the sealed enclosure 24 remains closed and locked. Thus, the sealed enclosure remains locked to prevent tampering and valve activation time is shortened. The illustrated remote triggering system 128 includes a power source 108, a controller 110 in communication with the power source 108, a solenoid-activated valve 43A in communication with the controller 110, and a remote triggering device 130 in communication with the controller 110. The illustrated power source 108 is located within the sealed enclosure 24 and can be any suitable source of electric power such as, for example, a battery and the like but any other suitable source of electric power can alternatively be utilized such as, for example mains electricity. The illustrated controller 110 is located within the sealed enclosure 24 and includes a processor programmed to perform all necessary functions of the remote triggering system 128. The illustrated solenoid-activated valve 34A is associated with the pressurized container 26 to control release of the nonlethal chemical weapon from the container 26. The solenoid-activated valve 43A can be any suitable type of remotely controlled valve. The illustrated remote triggering device 130 is located outside the sealed enclosure 24 and within the first space 18 and has either a wireless or wired connection with the controller 110. The remote triggering device 130 can be of any suitable type. The remote triggering device 130 can be carried by a user within the first space 18. For example, when the building 16 is a school and the connection is wireless, a classroom teacher can carry the remote triggering device 130 within the classroom 18 with a lanyard or the like so that the remote triggering device 130 is with them at all time while in the classroom 18. Thus, the nonlethal device 12 can be quickly activated at all times via the remote triggering device 130 while the sealed container 24 can remain locked so that the students do not have access for tampering and the like. A central remote triggering device 132 can additionally or alternatively be in communication with the controller 110, either wired or wireless, and located at a remote location 118 (that is, remote from the first space 18) such as, for example, a security office for the building 16. The central remote triggering device 132 enables a single person to remotely activate any one, all, or a select number of the nonlethal devices 12 within the building 16.

Figure 17:
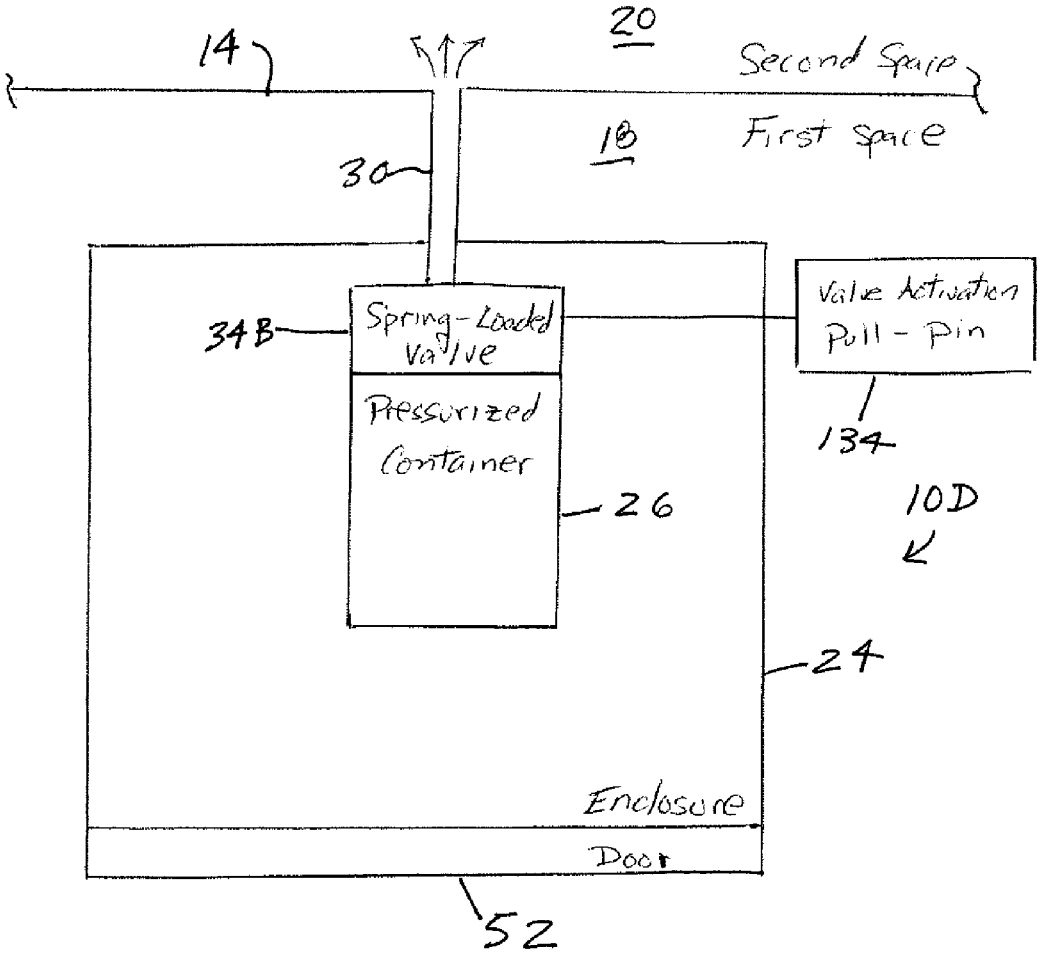
FIG. 17 is a schematic view of a fifth embodiment of the system for defending against intruders according to the present invention.

FIG. 17 schematically illustrates a system 10D for defending against building intruders according to a fifth embodiment of the present invention. This fifth embodiment is substantially the same as the first, second, third, and fourth embodiments described above except that it includes a valve-actuation pull pin 134 that activates a spring-loaded valve 43B to release the nonlethal chemical weapon without opening the sealed enclosure 24. The valve-actuation pull pin 134 is at least partially located outside the sealed enclosure 24 so that it can be quickly grasped and pulled by a user within the first space 18. The spring-loaded valve 34B is spring biased to an actuated or open position to release the nonlethal chemical weapon but is typically held in an unactuated or closed position by the valve-actuation pull pin 134. When a user pulls the valve-actuation pull pin 134 to release it from the spring-loaded valve 34B, the spring-loaded valve 34B automatically moves to the actuated or open position due to the bias of the spring and thus the nonlethal chemical weapon is released. The spring-loaded valve 34B can be of any suitable type and the valve-actuation pull pin 134 can be of any suitable type.

Any of the features or attributes of the above the above described embodiments and variations can be used in combination with any of the other features and attributes of the above described embodiments and variations as desired.

It is apparent from the above detailed description of preferred embodiments of the present invention, that the above-disclosed device is a versatile and easy to use wall-mounted device that has limited access but is available when an intruder is present without exposing the operator or others within the room to the intruder.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A wall-mounted nonlethal device for defending against an intruder to a building operable through a wall dividing first and second spaces, said nonlethal device comprising, in combination:

a wall-mounted enclosure including a front wall having an enclosure opening therein and configured to be mounted to the wall of the building with threaded fasteners within the first space;

wherein the wall-mounted enclosure further includes top, bottom, left side, and right side walls rearwardly extending from the front wall and cooperating with the front wall to form sealed interior compartment accessible through a rearward-facing access opening, and an access door for selectively accessing the interior compartment of the wall-mounted enclosure through the rearward-facing access opening from the first space and selectively closing the rearward-facing accesses opening to seal the rearward-facing access opening;

a container of a nonlethal chemical weapon secured within the sealed interior compartment of the wall-mounted enclosure and having an outlet located within the sealed interior compartment of the wall-mounted enclosure; wherein the nonlethal chemical weapon is configured to form a vapor cloud upon release to at least one of irritate the intruder and incapacitate the intruder and comprises at least one of tear gas, capsaicin, pepper spray (OC gas), o-chlorobenzylidene malononitrile, CS gas, dibenzoxazepine (CR gas), phenacyl chloride (CN gas), nonivamide, bromoacetone, xylyl bromide, and syn-propanethial-S-oxide;

a conduit extending through the enclosure opening in the front wall of the wall-mounted enclosure to seal the enclosure opening, and having an inlet end located within the sealed interior compartment of the wall-mounted enclosure in fluid flow communication with the outlet of the container of the nonlethal chemical weapon and an outlet end located outside the wall-mounted enclosure and configured to be in fluid flow communication with the second space;

a valve located within the sealed interior compartment of the wall-mounted enclosure and operable to selectively release the nonlethal chemical weapon from the container and through the conduit to form a cloud of the nonlethal chemical weapon within the second space; and wherein the threaded fasteners sealingly extend through the front wall from the sealed interior space to seal the sealed interior space and prevent release of the nonlethal chemical weapon except through the conduit when the access door is closed.

2. The wall-mounted nonlethal device according to claim 1, wherein the rearward-facing access opening of the wall-mounted enclosure is sealed with a seal encircling the rearward-facing access opening to prevent release of the nonlethal chemical weapon except through the conduit when the access door is closed.

3. The wall-mounted nonlethal device according to claim 1, wherein the container is a canister and the valve is a manually actuated valve located within the interior compartment of the wall-mounted enclosure at a top of the canister and operable to selectively release the nonlethal chemical weapon from the canister and through the conduit when the manually-actuated valve is manually depressed within the interior compartment of the wall-mounted enclosure by an operator located within the first space.

4. The wall-mounted nonlethal device according to claim 3, wherein the canister is secured within the wall-mounted enclosure by a plastic tie strap having a tape section with teeth that extends through a head section to tighten the tie strap.

5. The wall-mounted nonlethal device according to claim 1, wherein the nonlethal chemical weapon comprises Orthoclorobenzalmolonitrile and Oleo Resin Capsicum dissolved in a blend of highly volatile non-flammable solvents.

6. The wall-mounted nonlethal device according to claim 1, wherein the conduit is a flexible plastic tube and the conduit and the enclosure opening are sized and shaped so that the conduit seals the enclosure opening as the conduit extends therethrough.

7. The wall-mounted nonlethal device according to claim 6, wherein the outlet end of the conduit is provided with a flared tube fitting.

8. The wall-mounted nonlethal device according to claim 1, further comprising a security seal on the wall-mounted enclosure and configured to be broken when the access door of the wall-mounted enclosure is opened.

9. A system for defending against an intruder, said system comprising, in combination:

a building having a wall dividing first and second spaces; and a wall-mounted nonlethal device operable through the wall of the building and including:

a wall-mounted enclosure including a front wall having an enclosure opening therein and mounted to the wall of the building with threaded fasteners within the first space;

wherein the wall-mounted enclosure further includes top, bottom, left side, and right side walls rearwardly extending from the front wall and cooperating with the front wall to form sealed interior compartment accessible through a rearward-facing access opening, and an access door for selectively accessing the interior compartment of the wall-mounted enclosure through the rearward-facing access opening from the first space and selectively closing the rearward-facing accesses opening to seal the rearward-facing access opening;

a container of a nonlethal chemical weapon secured within the sealed interior compartment of the wall-mounted enclosure and having an outlet located within the sealed interior compartment of the wall-mounted enclosure; wherein the nonlethal chemical weapon is configured to form a vapor cloud upon release to at least one of irritate the intruder and incapacitate the intruder and comprises at least one of tear gas, capsaicin, pepper spray (OC gas), o-chlorobenzylidene malononitrile, CS gas, dibenzoxazepine (CR gas), phenacyl chloride (CN gas), nonivamide, bromoacetone, xylyl bromide, and syn-propanethial-S-oxide;

a conduit extending through the enclosure opening in the front wall of the wall-mounted enclosure to seal the enclosure opening and through the wall to the second space, and having an inlet end located within the sealed interior compartment of the wall-mounted enclosure and in fluid flow communication with the outlet of the container of the nonlethal chemical weapon and an outlet end located outside the wall-mounted enclosure and in fluid flow communication with the second space;

a valve located within the sealed interior compartment of the wall-mounted enclosure and operable to selectively release the nonlethal chemical weapon from the container and through the conduit to the second space to form a cloud of the nonlethal chemical weapon within the second space; and wherein the threaded fasteners sealingly extend through the front wall from the sealed interior space to seal the sealed interior space and prevent release of the nonlethal chemical weapon except through the conduit when the access door is closed.

10. The system according to claim 9, wherein the wall-mounted enclosure is sealed with a seal encircling the rearward-facing access opening to prevent release of the nonlethal chemical weapon except through the conduit when the access door is closed.

11. The system according to claim 9, wherein the container is a canister and the valve is a manually actuated valve located within the interior compartment of the wall-mounted enclosure at a top of the canister and operable to selectively release the nonlethal chemical weapon from the canister and through the conduit when the manually-actuated valve is manually depressed within the interior compartment of the wall-mounted enclosure by an operator located within the first space.

12. The system according to claim 11, wherein the canister is secured within the wall-mounted enclosure by a plastic tie strap having a tape section with teeth that extends through a head section to tighten the tie strap.

13. The system according to claim 9, wherein the nonlethal chemical weapon comprises Orthoclorobenzalmolonitrile and Oleo Resin Capsicum dissolved in a blend of highly volatile non-flammable solvents.

14. The system to claim 9, wherein the conduit is a flexible plastic tube and the conduit and the enclosure opening are sized and shaped so that the conduit seals the enclosure opening.

15. The system according to claim 14, wherein the outlet end of the conduit is provided with a flared tube fitting mounted flush with the wall of the building at the second space.

16. The system according to claim 9, further comprising a security seal on the wall-mounted enclosure and configured to be broken when the access door of the wall-mounted enclosure is opened.

17. A system for defending against an intruder, said system comprising, in combination:

a building having an interior wall dividing a room space from a hallway space, and an interior door between the room space and the hallway space; and a wall-mounted nonlethal device operable through the interior wall of the building and including:

a wall-mounted enclosure including a front wall having an enclosure opening therein and mounted to the interior wall with threaded fasteners within the room space;

wherein the wall-mounted enclosure further includes top, bottom, left side, and right side walls rearwardly extending from the front wall and cooperating with the front wall to form a sealed interior compartment accessible through a rearward-facing access opening, and an access door for selectively accessing the interior compartment of the wall-mounted enclosure through the rearward-facing access opening from the room space and selectively closing the rearward-facing accesses opening to seal the rearward-facing access opening;

a canister of a nonlethal lachrymator located within the sealed interior compartment of the wall-mounted enclosure and having an outlet located within the sealed interior compartment of the wall-mounted enclosure and a manually-operated valve located within the interior compartment of the wall-mounted enclosure at a top of the canister for selectively releasing the nonlethal lachrymator from the canister when the manually-actuated valve is manually depressed within the interior compartment of the wall-mounted enclosure;

wherein the nonlethal chemical weapon is configured to form a vapor cloud upon release to at least one of irritate the intruder and incapacitate the intruder and comprises at least one of tear gas, capsaicin, pepper spray (OC gas), o-chlorobenzylidene malononitrile CS gas, dibenzoxazepine (CR gas), phenacyl chloride (CN gas), nonivamide, bromoacetone, xylyl bromide, and syn-propanethial-S-oxide;

a flexible plastic tube extending through the enclosure opening in the front wall of the wall-mounted enclosure to seal the enclosure opening and through the interior wall of the building to the hallway space;

the flexible plastic tube having an inlet end located within the sealed interior compartment of the wall-mounted enclosure and in fluid flow communication with the outlet of the canister and an outlet end located outside the wall-mounted enclosure and in fluid flow communication with the hallway space;

wherein the threaded fasteners sealingly extend through the front wall from the sealed interior space to seal the sealed interior space and prevent release of the nonlethal chemical weapon except through the conduit when the access door is closed; and wherein the manually-operated valve is manually depressed within the interior compartment of the wall-mounted enclosure through the access opening by an operator located within the room space to release the nonlethal lachrymator from the canister located within interior compartment of the wall-mounted enclosure to the hallway space through the flexible plastic tube to form a cloud of the nonlethal lachrymator within the hallway space near the interior door.

18. The wall-mounted nonlethal device according to claim 1, wherein the threaded fasteners are threaded through the front wall.

19. The system for defending against an intruder according to claim 9, wherein the threaded fasteners are threaded through the front wall.

20. The system for defending against an intruder according to claim 17, wherein the threaded fasteners are threaded through the front wall.

* * * * *